US007959007B1

(12) United States Patent
Ballentine et al.

(10) Patent No.: US 7,959,007 B1
(45) Date of Patent: Jun. 14, 2011

(54) SHIPPING AND DISPLAY CONTAINER WITH ARTICLE SUPPORT

(75) Inventors: John Robert Ballentine, Fayetteville, AR (US); Richard George Wachter, Batavia, IL (US); Sherwood Dean Kemp, Morrilton, AR (US); Michael Gene Long, Conway, AR (US); Melvin Scott Miller, Rison, AR (US)

(73) Assignee: International Paper Co., Memphis, TN (US)

( * ) Notice: Subject to any disclaimer, the term of this patent is extended or adjusted under 35 U.S.C. 154(b) by 0 days.

(21) Appl. No.: 12/648,466

(22) Filed: Dec. 29, 2009

(51) Int. Cl.
*B65D 5/54* (2006.01)

(52) U.S. Cl. ..... 206/774; 206/736; 229/939

(58) Field of Classification Search ..... 206/736, 206/738, 45.21, 45.25, 45.29, 784, 774, 486, 206/562, 563; 229/164, 939
See application file for complete search history.

(56) References Cited

U.S. PATENT DOCUMENTS

| | | | | |
|---|---|---|---|---|
| 2,885,073 | A * | 5/1959 | Bettoli et al. | 206/324 |
| 2,885,137 | A * | 5/1959 | Guyer | 229/125.19 |
| 3,009,622 | A | 11/1961 | Leone | |
| 3,313,407 | A | 4/1967 | Palm, Jr. | |
| 3,314,530 | A | 4/1967 | Michalka | |
| 3,856,137 | A | 12/1974 | Brindley | |
| 3,881,648 | A * | 5/1975 | Hall | 229/112 |
| 4,485,922 | A | 12/1984 | Desmond et al. | |
| 4,582,194 | A | 4/1986 | Karpiloff et al. | |
| 4,832,199 | A | 5/1989 | Rigby | |
| 5,195,677 | A * | 3/1993 | Quintana et al. | 229/117.07 |
| 5,316,138 | A | 5/1994 | Thompson | |
| 5,322,167 | A * | 6/1994 | Birutis et al. | 211/50 |
| 5,482,724 | A * | 1/1996 | Morici et al. | 426/124 |
| 5,505,309 | A | 4/1996 | Taravella et al. | |
| 5,573,117 | A | 11/1996 | Adams | |
| 5,826,716 | A * | 10/1998 | Wilson | 206/304 |
| D412,631 | S | 8/1999 | Green | |
| 5,979,662 | A | 11/1999 | Green | |
| 6,027,017 | A * | 2/2000 | Kuhn et al. | 229/120.011 |
| D452,820 | S | 1/2002 | Hacker | |
| 6,427,842 | B1 | 8/2002 | Green | |
| 6,431,363 | B1 | 8/2002 | Hacker | |
| 6,454,107 | B1 | 9/2002 | Belanger et al. | |
| 2010/0018894 | A1 * | 1/2010 | Hession | 206/765 |

* cited by examiner

*Primary Examiner* — J. Gregory Pickett
*Assistant Examiner* — Robert Poon
(74) *Attorney, Agent, or Firm* — Matthew M. Eslami

(57) ABSTRACT

A one-piece tray for shipping and then displaying articles in an upright position at a point of sale has a bottom wall, a front wall, a back wall, and opposite side walls and is made of corrugated board having a bottom liner, a top liner, and a fluted medium. A plurality of grooves extend across the width of the bottom wall in a top surface thereof to engage bottom edges of articles standing upright in the tray and hold them in position as other articles are removed from the front of the tray. The grooves are formed by cuts made through the top liner and a portion of the medium and crushed areas extending along one side of each cut, forming a rearwardly facing abutment at each cut for engaging bottom edges of articles to prevent the bottom edges from sliding forward in the tray.

6 Claims, 5 Drawing Sheets

SHIPPING AND DISPLAY CONTAINER WITH ARTICLE SUPPORT

TECHNICAL FIELD

This invention relates generally to packaging, and more particularly to a shipping and display container that is used to ship a plurality of articles and then display the articles in an upright position at the point of sale.

BACKGROUND ART

Many products for sale to the public are placed in a primary package that is designed for display at the point of sale. Common practice is to place a quantity of the primary packages in a secondary container for shipping. The retailer must then remove the primary packages from the secondary container and hang them from a hook or place them in another container or on a shelf for display. One common practice is to remove the primary packages from the shipping container and place them on a costly permanent plastic or metal display fixture with spring loaded attachments. This solution is labor intensive and costly to the retailer.

To solve this problem, packages have been designed that are used for both shipping the primary packages and then displaying them at the point of sale. These packages are especially convenient for the retailer, since it is not necessary for the retailer to remove the articles from a bulk shipping container.

One conventional container known to applicant suitable for both shipping articles and then displaying them with maximum visual exposure at a point of sale comprises a tray having a smooth bottom wall and relatively narrow upstanding side walls. The articles are supported on the bottom wall and preferably extend above the side walls. For shipping, a cover is placed over the tray loaded with items or the loaded tray is placed in an outer shipping container to form a shipping package. When the shipping package reaches its destination the tray loaded with items is removed from the shipping container and placed on a shelf or other surface for display and sale of the items supported in the tray.

A commonly used primary package comprises a blister pack or clamshell package wherein the article is placed on a sheet of cardboard or plastic and then covered by a plastic sheet or bubble that is sealed around the edges to the sheet. These packages are collectively referred to hereinafter as blister packs, but it should be understood that this terminology is intended to cover any generally flat package having at least one substantially straight projecting marginal edge. A plurality of blister packs are placed in upright position in these trays. However, because of their shape and the location of their center of gravity, most blister packs tend to fall over or slide forward at their bottom edge and are therefore no longer supported in an upright position when some of the articles are removed by consumers from the front of the tray. Consequently, for blister packs to be properly displayed in a shallow tray, it is necessary to provide a support structure to hold the blister packs in an upright position even when some of the blister packs are removed from the front of the tray.

One prior art system that has been proposed utilizes a separate insert positioned in the tray and having slots or protuberances that engage opposite side and/or bottom edges of the blister packs to hold them upright even after some blister packs have been removed from the tray. Other prior art systems comprise specially constructed and folded walls that extend into the interior of the tray and have slots for receiving edges of the blister packs to hold them upright. All of these prior art systems require either additional parts, such as inserts placed in the tray, or excess material to form the specially constructed and folded walls.

It would be advantageous to have a shipping and display container that supports and displays articles in an upright position for optimum visibility at a point of sale without the need for separate inserts or excess material, thereby minimizing the complexity and cost of such containers.

DISCLOSURE OF THE INVENTION

The present invention comprises a simple and inexpensive container for shipping and displaying articles in an upright position at a point of sale without the need for separate inserts or excess material, thereby minimizing the complexity and cost of such containers.

The container of the invention comprises a shallow tray having a bottom wall and upstanding front, back, and side walls, with articles supported on the bottom wall and preferably extending above the front and side walls, although it should be understood that the articles need not extend above the side walls or at least not all of them, so long as the articles are visible and easily accessible while supported in the tray. For shipping, a cover is placed over the tray loaded with items, or the loaded tray is placed in an outer box. At the point of sale the cover is removed from the loaded tray, or the tray is removed from the shipping box, and the loaded tray is placed on a shelf or other surface for display and sale of the articles.

In a preferred construction the tray and cover are each made from a single blank of corrugated cardboard scored, folded, and held in erected position by glue panels. In the preferred construction the flutes of the corrugated medium extend longitudinally of the bottom wall. A plurality of parallel cuts are made through the liner and up to about one-half the thickness of the fluted medium of the bottom wall, extending transversely across the width of the bottom wall and spaced apart distances calculated to correspond to the locations of the bottom edges of a plurality of articles placed upright in contiguous front-to-back relationship in the tray. The material of the bottom wall is crushed adjacent each cut on the side thereof toward the back wall of the tray, forming a groove and rearwardly facing lip or abutment at each cut. The grooves defined by the cuts and compressed areas create a "ribbed" effect on the inside bottom surface of the tray, preventing primary packaging with a projecting marginal edge from sliding forward, as the edge catches on the rearwardly facing abutment formed by the uncompressed material on the forward side of the cut line. This function can be used in "shelf ready" packaging to assist the primary package in staying upright during the store display and shop mode as the primary packages are removed from the front of the tray.

The advantages provided by the invention are the elimination of secondary inserts or other mechanisms or packaging components of similar or different materials to perform the same function, with resultant cost savings to the customer.

The invention also eliminates the requirement for permanent store fixtures used to perform the function of holding primary packages upright, and reduces the re-stocking labor required by permanent displays.

The invention also permits a low-cost, source-reduced, recyclable package to be used in lieu of other costly and non-environmentally friendly options.

The invention is also capable of being produced on automatic packaging machines for carton erection and filling, and placing the product into the secondary package.

From a package production perspective, the invention can be applied using current existing flatbed die cutting operations such as those used in International Paper Company's Conway, Ark. facility.

BRIEF DESCRIPTION OF THE DRAWINGS

The foregoing, as well as other objects and advantages of the invention, will become apparent from the following detailed description when taken in conjunction with the accompanying drawings, wherein like reference characters designate like parts throughout the several views, and wherein.

BEST MODE FOR CARRYING OUT THE INVENTION

Figure 1:
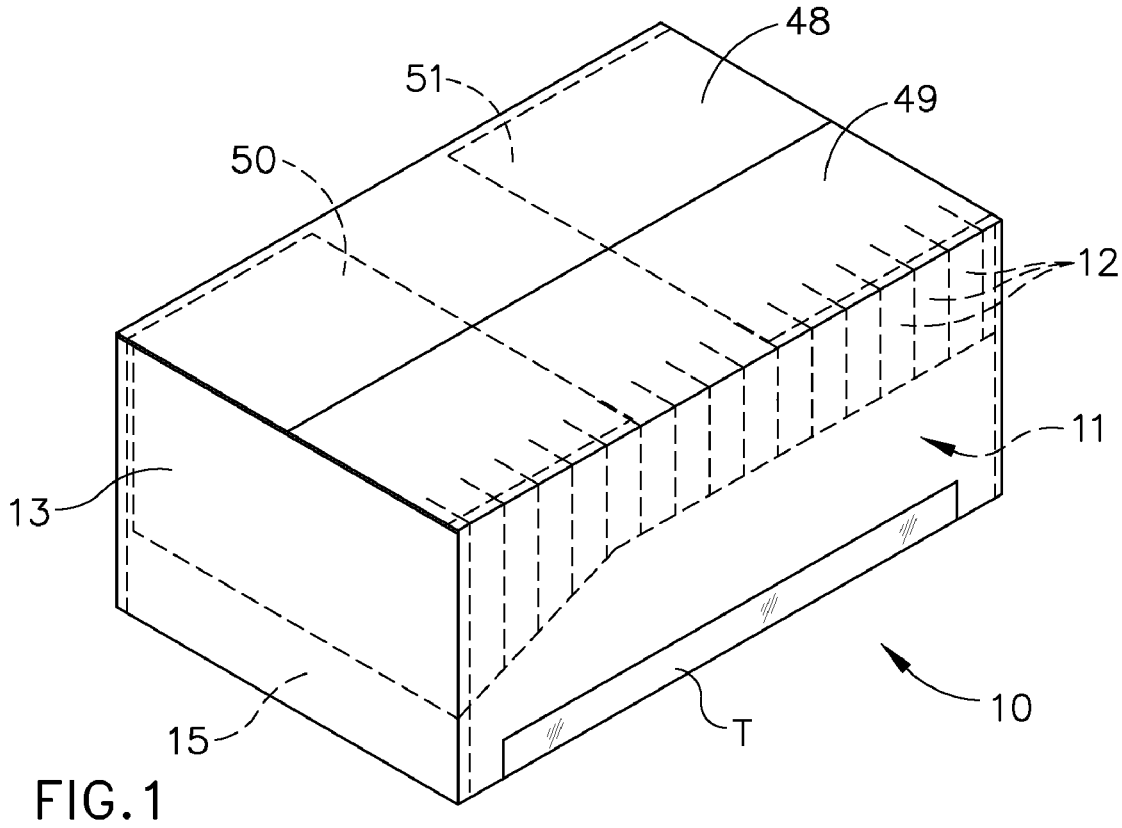
FIG. 1 is a top perspective view of a shipping and storage package according to the invention.
Figure 2:
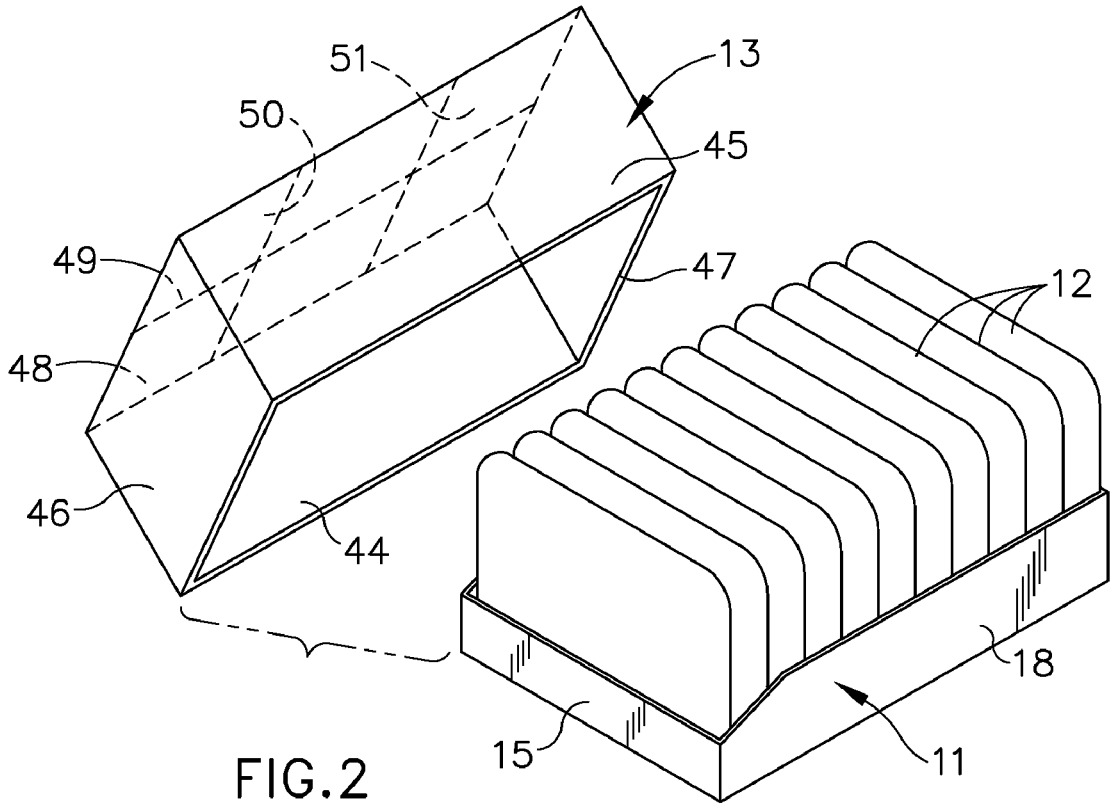
FIG. 2 is an exploded top perspective view, on a somewhat reduced scale, showing the cover being removed from the shipping and display tray of the invention.

With more specific reference to the drawings, a shipping package in accordance with the invention is shown generally at 10 in FIGS. 1 and 2. The package comprises a display tray or secondary package 11 loaded with articles or primary packages 12, and an outer shipping cover 13. The display tray and articles are shown in broken lines since they are hidden by the cover in this view. In use, the cover may be spot glued to the tray, or secured thereto with tape "T" as shown in FIG. 1.

Figure 3:
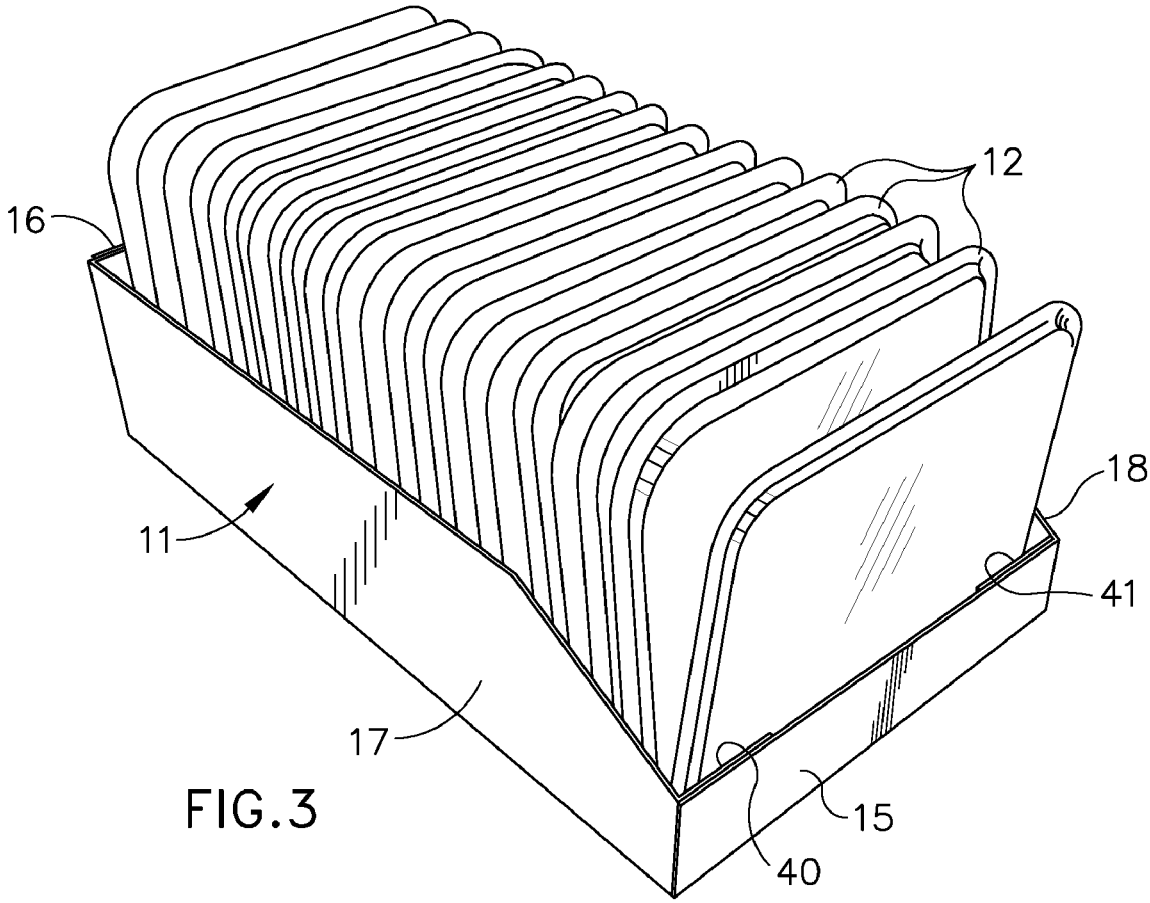
FIG. 3 is a top front perspective view of a shipping and display tray according to the invention, shown loaded with articles having at least one straight projecting marginal edge, such as blister packs.
Figure 4:
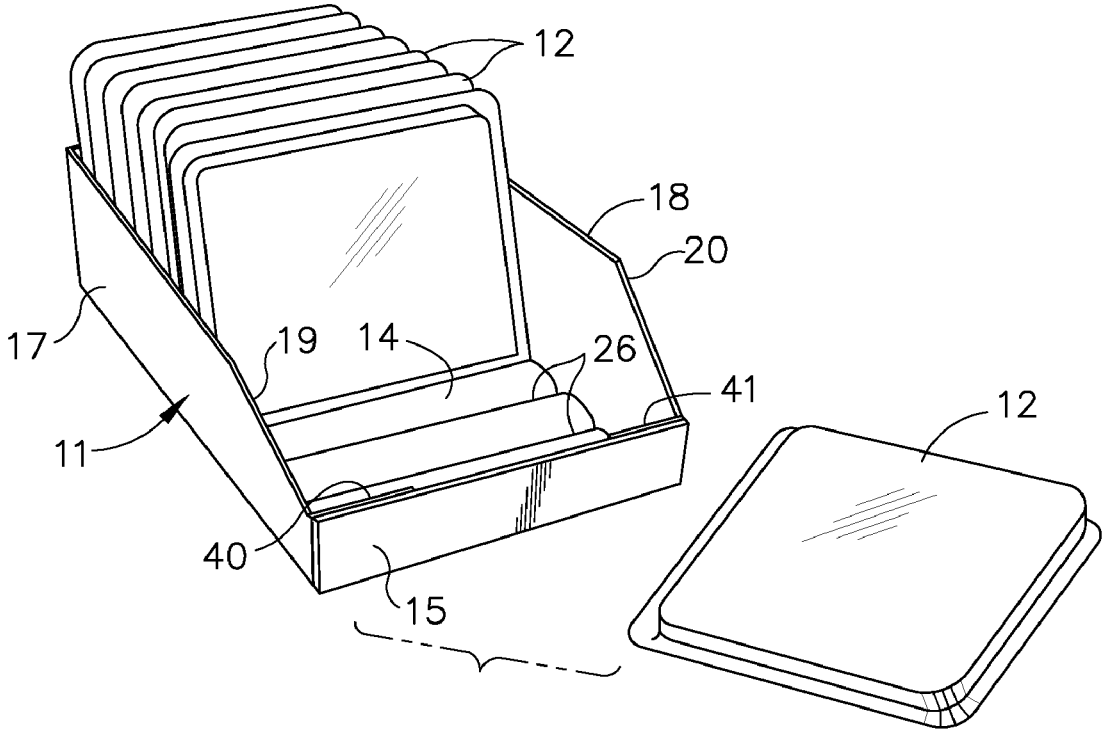
FIG. 4 is a top front perspective view, on a somewhat reduced scale from FIG. 5, showing some of the blister packs removed from the front of the tray and depicting how the grooves formed by the cuts and crushed areas restrain the bottom edges of blister packs remaining in the tray from sliding forward, whereby the remaining blister packs remain in an upright position in the tray.
Figure 5:
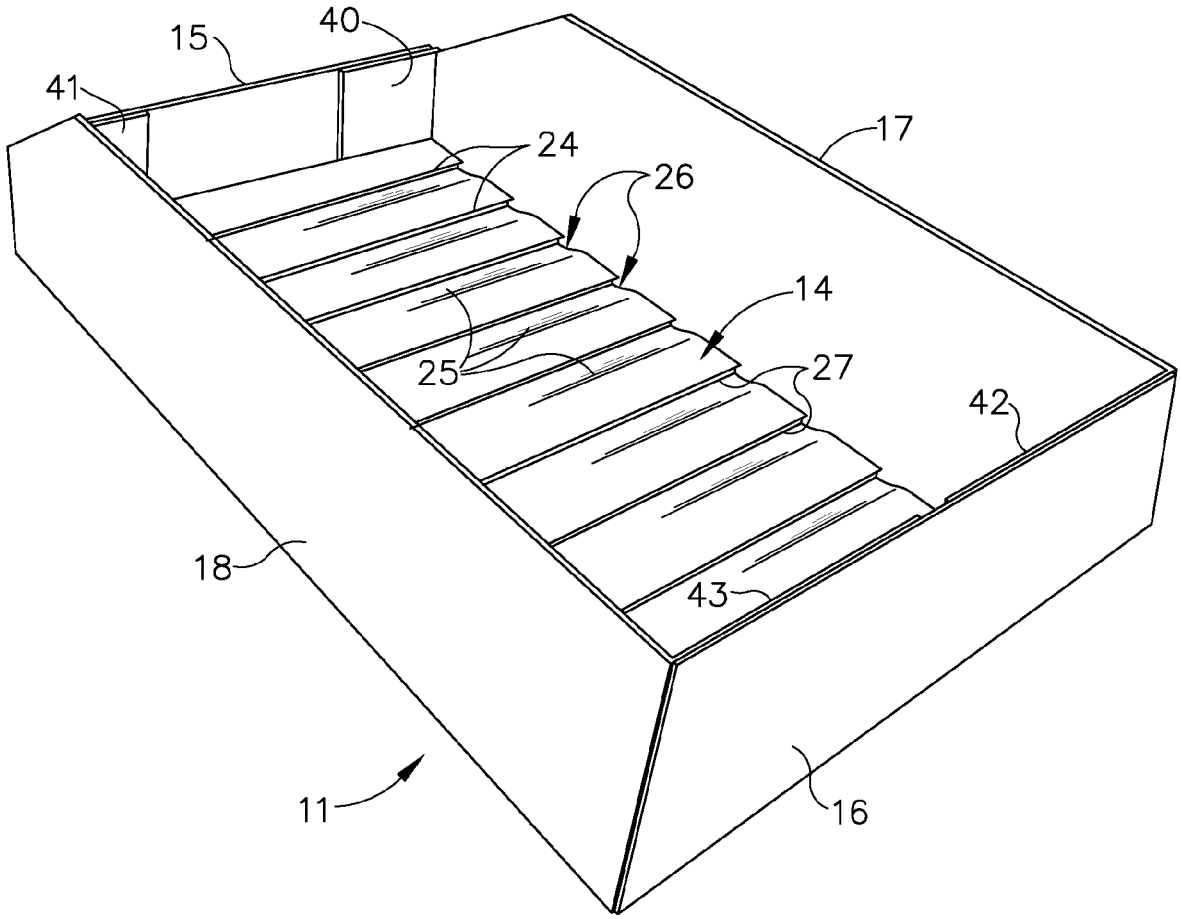
FIG. 5 is an enlarged top rear perspective view of the tray of FIG. 3, with all articles or primary packages removed and showing the arrangement of the cuts and crushed areas in the bottom wall.

The display tray 11 is shown in greater detail in FIGS. 3-9. In FIG. 3 the tray is shown fully loaded with articles, such as blister packs 12, and in FIG. 4 some of the articles have been removed from the front of the tray.

The tray has a bottom wall 14, front wall 15, back wall 16, and opposite side walls 17 and 18. In the particular example shown, the front wall 15 has less height than the back wall 16 and the upper edges 19, 20 of the side walls adjacent the front wall are tapered downwardly to meet the upper edge of the front wall.

Figure 8:
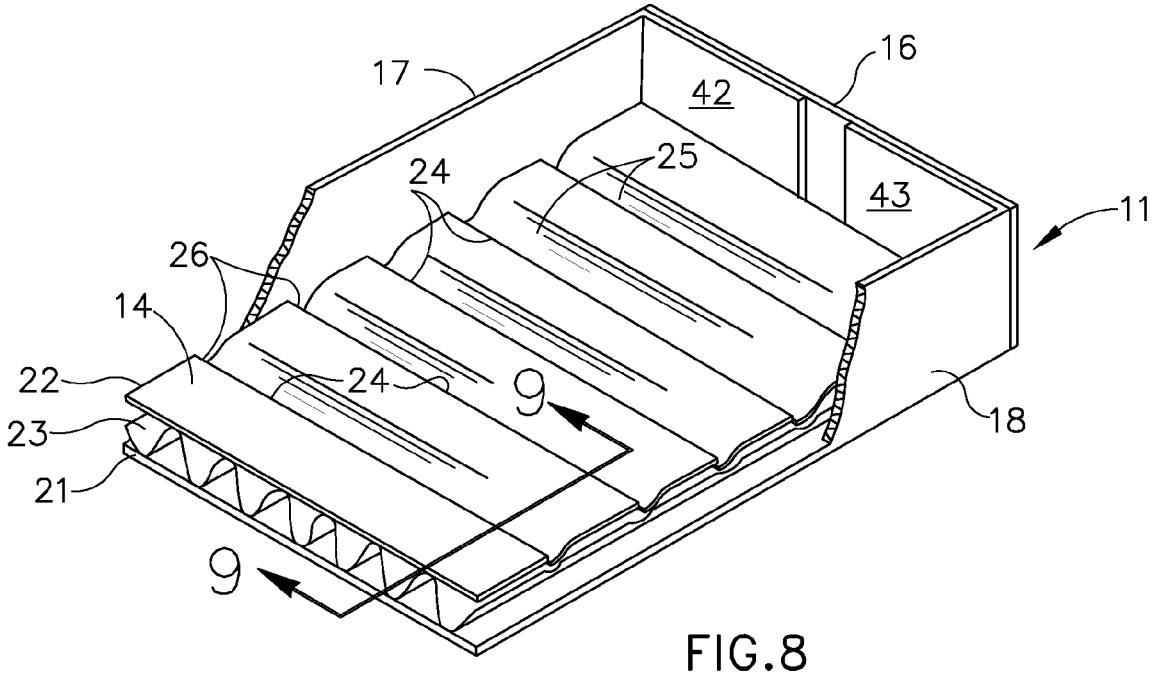
FIG. 8 is a fragmentary front top perspective view of the tray of the invention, with the front wall omitted, portions of the side walls cut away, and the bottom wall shown in greatly exaggerated thickness for the purpose of illustrating the relationship of the flutes of the corrugated medium with the cuts and crushed areas made in the top surface of the bottom wall.
Figure 9:
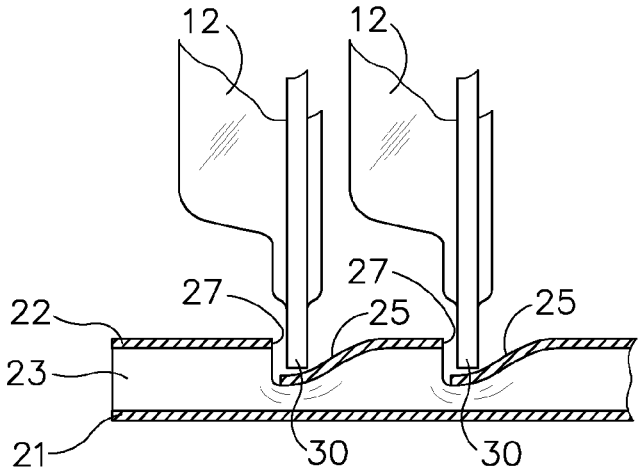
FIG. 9 is a further enlarged fragmentary sectional view taken along line 9-9 in FIG. 8, showing how the bottom edges of blister packs are engaged in the grooves formed in the top surface of the bottom wall of the tray.

As seen best in FIGS. 8 and 9, the corrugated material of the bottom wall 14 comprises a bottom liner 21, a top liner 22, and a fluted medium 23. A plurality of spaced apart, parallel, transverse cuts 24 are made through the top liner and about one-half the thickness of the medium, extending across the width of the bottom wall, and the material of the bottom wall is crushed in areas 25 adjacent the cuts on the side thereof toward the rear of the tray, forming grooves or depressed areas 26 along the side of the cuts toward the rear of the tray. The uncrushed areas on the side of the cuts toward the front of the tray form rearwardly facing lips or abutments 27.

With the foregoing structure, when a plurality of primary packages or articles 12 are placed in the tray, the bottom edges 30 thereof are received in the grooves and abut against the abutments 27 so that when articles are removed from the front of the tray, the bottom edges of the articles remaining in the tray are prevented from sliding forward, whereby the remaining articles are held in their upright positions. It should be noted that in a particular example of a tray made in accordance with the invention the corrugated material from which the box is made has a thickness of only about ⅛ inch. Accordingly, the grooves 26 typically have a depth of only about 1/16 inch. However, the invention is not limited to these particular dimensional relationships.

Figure 6:
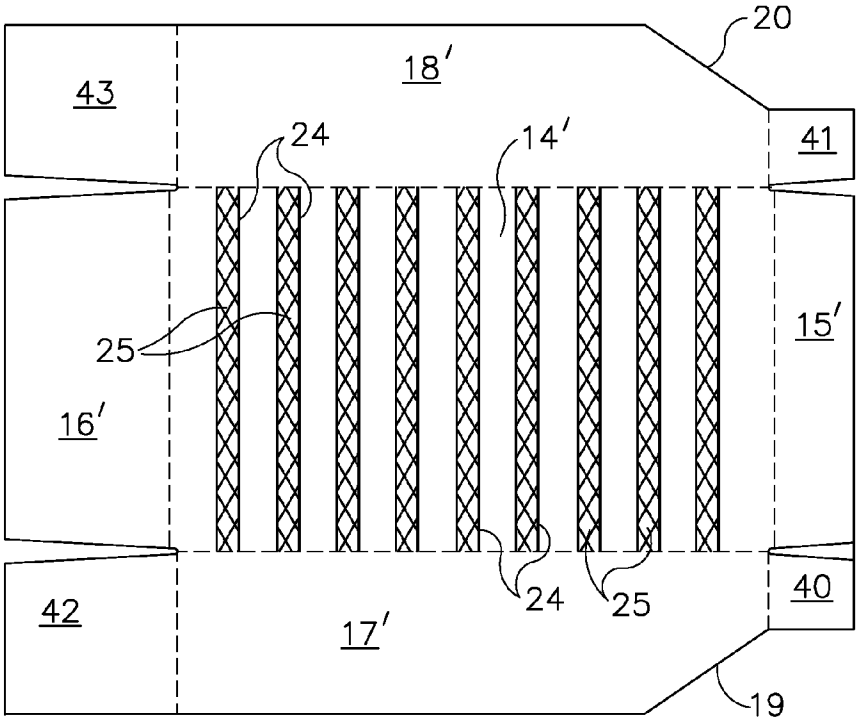
FIG. 6 is a top plan view of a blank for making the tray of the invention, showing the arrangement of transverse cuts and crushed areas.

A blank "B1" for making the tray of the invention is shown in FIG. 6. The blank comprises a bottom wall panel 14', front wall panel 15', back wall panel 16', and opposite side wall panels 17' and 18'. In the particular example shown, the front wall panel 15' has less height than the back wall panel 16' and the outer end edges 19, 20 of the side wall panels adjacent the front wall panel are tapered so that they meet the upper edge of the front wall in a container erected from the blank.

Glue flaps 40 and 41 are formed on the ends of respective side wall panels adjacent the front wall panel, and glue flaps 42 and 43 are formed on the opposite ends of respective side wall panels adjacent the back wall panel. As seen best in FIGS. 5 and 8, in a tray erected from the blank the glue flaps are disposed inside of and glued to the respective front and back walls.

Figure 7:
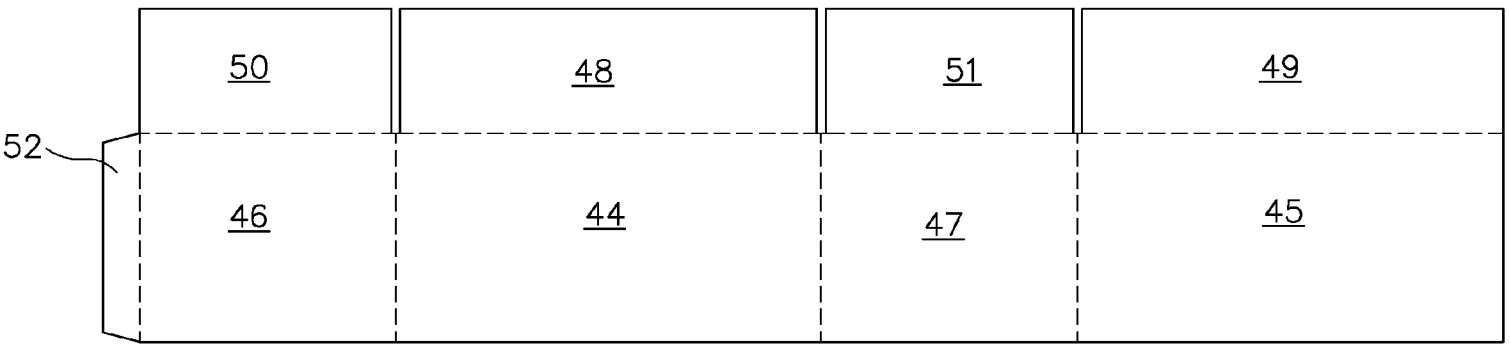
FIG. 7 is a top plan view of a blank for making a cover for the container of the invention.

A blank "B2" for making a cover according to the invention is shown in FIG. 7. The blank comprises first and second side wall panels 44 and 45, first and second end wall panels 46 and 47, first top wall flaps 48 and 49 foldably joined to an edge of respective side wall panels, and second top wall flaps 50 and 51 foldably joined to an edge of respective end wall panels. A glue tab 52 is foldably joined to an edge of an end wall panel 46 at one end of the blank for adhesive attachment to a side wall panel 45 in a cover erected from the blank. The top wall flaps are adhesively attached to each other where they overlap when they are folded inwardly to form a cover erected from the blank.

The container of the invention is simple and economical in construction, requiring minimal parts and material, and effectively holds a plurality of articles in upright position when displayed for sale.

What is claimed is:

1. A container capable of shipping a plurality of articles and displaying them in an upright position at a point of sale, the container comprising:

a one-piece shallow tray having a bottom wall, a front wall, a back wall, and opposite side walls, said bottom wall comprises a bottom liner, a fluted medium, and a top liner, said bottom wall having a plurality of parallel spaced apart grooves in a top surface thereof for engaging bottom edges of articles for supporting the article upright in the tray and hold them in position as other articles are removed from the front of the tray, said grooves are formed by cuts and adjacent crushed areas in the top surface of said bottom wall extending transversely across the width of the bottom wall, said cuts extending through the top liner but not completely through the fluted medium, and said crushed areas extend alongside said cuts and wherein said crushed areas extend along only that side of each respective said cut facing the back wall, forming a rearwardly facing abutment at each cut, said abutments engaging said bottom edges of said articles to prevent said bottom edges from sliding forward in the tray.

2. A container as claimed in claim 1, wherein:

said tray is made of corrugated board.

3. A container as claimed in claim 1, wherein:

said cuts extend through only about one-half the thickness of the fluted medium.

4. A container as claimed in claim 3, wherein:

said front wall, said back wall, and said side walls are integrally formed with said bottom wall and are foldably joined to respective edges thereof; and glue flaps are on opposite ends of said side walls, said glue flaps being folded inwardly and glued to an inner surface of a respective said front wall and said back wall.

5. A container as claimed in claim 4, wherein:

said front wall has less height than said back wall; and forward upper edges of said side walls are tapered downwardly to an upper edge of said front wall.

6. A container as claimed in claim 1, wherein:

a cover is secured over said tray loaded with said articles to form a shipping container.

* * * * *